US006907638B2

(12) United States Patent
Katz

(10) Patent No.: US 6,907,638 B2
(45) Date of Patent: Jun. 21, 2005

(54) TOOTHBRUSH WITH STAND

(76) Inventor: Robert Katz, 3570 Ridgewood, #305, Montréal, Quebec (CA), H3V 1C2

( * ) Notice: Subject to any disclaimer, the term of this patent is extended or adjusted under 35 U.S.C. 154(b) by 321 days.

(21) Appl. No.: 10/356,612

(22) Filed: Feb. 3, 2003

(65) Prior Publication Data

US 2004/0148724 A1 Aug. 5, 2004

(51) Int. Cl.[7] ..... A46B 5/00; A46B 9/04

(52) U.S. Cl. ..... 15/167.1; 15/143.1; 15/246; 248/688; 16/110.1; 401/131; D4/108

(58) Field of Search ..... 15/167.1, 143.1, 15/246; 248/688; 401/131; 16/110.1, 436; D4/104, 108; 132/308, 311; 211/65

(56) References Cited

U.S. PATENT DOCUMENTS

| | | | | | |
|---|---|---|---|---|---|
| 153,983 | A | * | 8/1874 | Rontey | 248/471 |
| 286,699 | A | * | 10/1883 | Hernberger | 248/471 |
| 1,870,924 | A | * | 8/1932 | Platzer | 248/688 |
| 4,033,007 | A | | 7/1977 | Hadary | |
| D287,791 | S | * | 1/1987 | Arnaud | D4/107 |
| D301,402 | S | * | 6/1989 | Hirsch | D4/108 |
| 544,889 | A | * | 8/1995 | Barre | 15/167.1 |
| 5,675,859 | A | * | 10/1997 | Barre | 15/167.1 |
| 5,687,855 | A | * | 11/1997 | Heller | 211/65 |
| 6,076,223 | A | | 6/2000 | Dair et al. | |
| 6,170,113 | B1 | | 1/2001 | Cornu et al. | |
| 6,253,406 | B1 | * | 7/2001 | Holland | 15/143.1 |
| 2003/0183241 | A1 | * | 10/2003 | Kemp et al. | 132/311 |

FOREIGN PATENT DOCUMENTS

| | | | |
|---|---|---|---|
| JP | 7-313251 | * | 5/1995 |

* cited by examiner

*Primary Examiner*—Gary K. Graham

(57) ABSTRACT

A stand-up toothbrush having an elongated handle with a head at one end, the head carrying bristles, and a hand holding portion at the other end, the hand holding portion long enough to be fully grasped by the hand of the user. A stand is provided on the hand holding portion of the handle at the other end, the stand extending past the other end of the handle and terminating in a support end. The support end extends transverse to the handle and is large enough to stably support the toothbrush in an upright storage position. The handle is made from relatively rigid material, and the stand is made from resilient, flexible material of the type allowing the stand to be moved against the hand holding portion of the handle when the user grasps the stand and the hand holding portion so as to interfere minimally with holding the toothbrush during use, and to return to its original position when the brush is released.

15 Claims, 1 Drawing Sheet

TOOTHBRUSH WITH STAND

BACKGROUND OF THE INVENTION

1. Field of the Invention

This invention is directed toward a toothbrush. The invention is more particularly directed toward a toothbrush having a stand by means of which the toothbrush can be stored in a standing position on a horizontal surface.

2. Description of the Related Art

It is known to store toothbrushes in an upright position so that they drain after use. Usually the brushes are stored in a wall holder, a surface support, or a container which supports them in an upright position. However, brushes are often used where there is no holder, support or container. In this instance, it is known to provide toothbrushes with a support means on the handle which will alone support the brush in an upright position on a horizontal surface. Examples of such brushes are shown in U.S. Pat. Nos. 4,033,007; 6,076,223 and 6,170,113.

All these known brushes have disadvantages however. The brush shown in U.S. Pat. No. 4,033,007 has the disadvantage that the enlarged handle end used to support the brush in an upright stored position interferes with holding the brush. The enlarged handle end is rigid and this makes it awkward to properly grasp the brush when brushing teeth. Also, the base of the enlarged portion is not very wide making it difficult for a child to store the brush in its upright position. The brush has to be carefully balanced on the handle end when set down so it will not tip over. The brush shown in U.S. Pat. No. 6,076,223 has a stand at the end of the handle but the stand is not very wide, no wider than the main portion of the handle. The narrow stand again makes it difficult for a child to store the brush in an upright position. The brush shown in U.S. Pat. No. 6,170,113 has an end handle section made up of rigid leg sections which leg sections flare outwardly to form a tripod for the brush when it is stored. The tripod arrangement makes it very easy to store the brush in an upright position. However this brush is quite complicated in construction requiring specially molded leg sections and more particularly special hinge-like connections between the legs and the rest of the handle and thus is expensive. In addition, the brush requires a separate movable ring member on the handle to be moved to bring the legs together when the brush is to be used and to be moved when storing the brush thus entailing further steps in using and storing the brush.

SUMMARY OF THE INVENTION

It is the purpose of the present invention to provide a toothbrush having a stand mounted on the handle of the brush which stand does not greatly interfere with the normal use of the brush and which stand makes it relatively easy, even for a child, to store the brush in an upright position.

In accordance with the present invention, a brush is provided having a handle made from rigid material but having the stand, mounted on the handle, made from resilient, flexible material. Having the stand made of resilient, flexible material allows the user to grasp the stand during use of the brush and easily squeeze it out of the way so as not unduly interfere with the operation of the brush. Once brushing is completed and the user releases the brush, the stand returns to its original shape without any further user assistance. Further, the stand is provided with a relatively large support end, large relative to the area size of the handle of the brush, so as to make it easy to set the brush down, using the stand, in an upright, storage position. The support end of the stand, relatively wide compared to the handle of the brush, makes it easier for a child to store the brush upright since the brush is not as liable to tip when setting the stand down on the horizontal surface.

The invention is particularly directed toward a stand-up toothbrush having an elongated handle having a first end and a second end and a head at the first end of the handle with bristles on the head. There is a a hand holding portion on the handle adjacent the second end of the handle, the hand holding portion at least long enough to be fully grasped by the hand of the user. There is a stand on the hand holding portion of the handle at the second end, the stand extending past the second end of the handle and terminating in a support end, the support end extending transverse to the handle. The support end, in its normal at-rest position, is normally encompassed by an imaginary circle having a diameter at least four times the width of the hand holding portion of the handle. The handle made from relatively rigid material. The stand is made from resilient, flexible material of the type allowing the stand to be squeezed from its at-rest position against the hand handle portion of the handle when the user grasps the stand and the hand handle portion to use the toothbrush, and allowing the stand to return to its at-rest position when the user releases his grasp after using the toothbrush. The stand, when in its at-rest position and placed with its support end on a horizontal surface, supports the toothbrush in an upright storage position. Preferably, the stand is integral with the handle.

DESCRIPTION OF THE PREFERRED EMBODIMENTS

Figure 1:
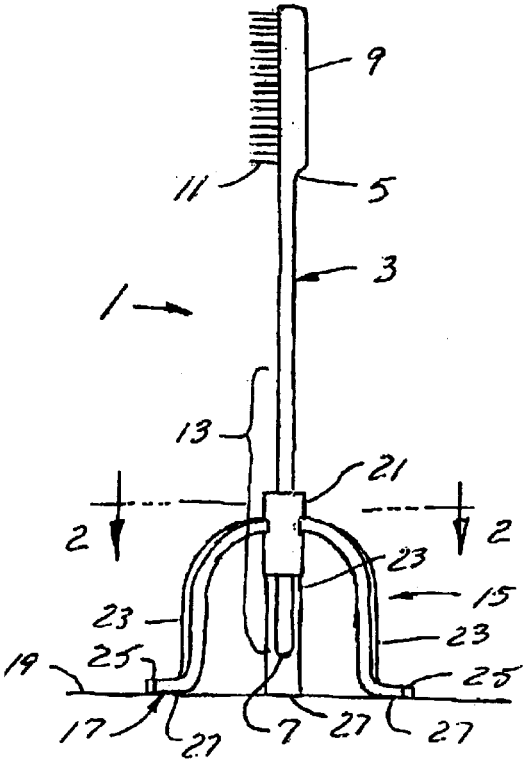
FIG. 1 is a front view showing one embodiment of the toothbrush.
Figure 2:
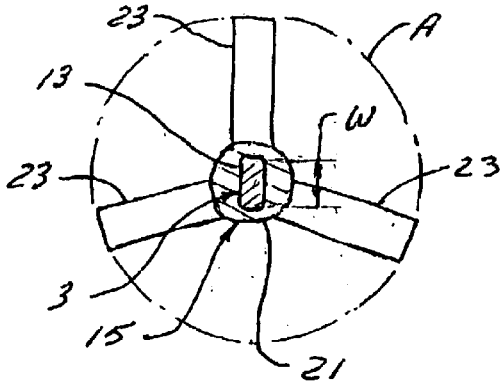
FIG. 2 is a cross-section view taken along line 2—2 in FIG. 1.

The toothbrush 1 of the present invention, as shown in FIGS. 1 and 2, has an elongated, rigid, handle 3 with first and second ends 5, 7. The brush 1 has a head 9 at the first end 5, the head 9 carrying the cleaning bristles 11. The handle 3 has a hand holding portion 13 adjacent the second end 7, the hand holding portion 13 long enough to be fully grasped by the hand of a user. The handle 3 is long enough to reach all the teeth to be brushed while fully grasping the hand holding portion 13 of the handle. The handle 3 can range in length from between four and seven inches and preferably is between five and six inches long. The handle, particularly in the hand holding portion, can range in width from between three-eighths and five-eighths inches and preferably is around one half-inch in width.

A stand 15 is provided on the hand holding portion 13 of the handle 3. The stand 15 extends in both a longitudinal and radial direction away from the hand holding portion 13 to project past the second end 7 of the handle 3 and terminate in a support end 17. The support end 17 of the stand 15 is transverse to the handle 3 and supports the brush 1 in an upright storage position on a horizontal surface 19 as shown in FIG. 1.

In more detail, the stand 15 has, as shown, a central collar 21 adapted to encircle the hand portion 13 of the handle 3 with at least three legs 23 extending outwardly and downwardly away from the collar 21. (The terms 'outwardly' and 'downwardly' are used when describing the brush in a standing, storage, position) The legs 23 are preferably equally spaced about the collar 21. More than three legs can be used. Each leg 23 preferably is curved outwardly and downwardly from the collar 21 to terminate in an outwardly directed flat foot 25. The bottom 27 of the three feet 25 form the support end 17 of the stand 15. The support end 17 of the stand is located past the second end 7 of the handle 3 so that the handle does not interfere when the stand 15, and the brush 1 carried thereby, is supported by its support end 17. The stand 15 is constructed so as to have, when in its normal at-rest position, an imaginary circle 'A', as shown in FIG. 2, which encompasses its support end 17, with a diameter at least four times the width 'W' of the widest part of the hand holding portion 13 of the handle 3 to provide a stable platform for the brush. Preferably the imaginary circle has a diameter of between five and six times the width 'W' of the hand holding portion. The wider the support end 17, relative to the width of the hand holding portion, the easier it is for a child to leave the brush upright after use.

Preferably, the stand 15 is mounted on the hand holding portion 13 of the handle 3 to have a major portion of the stand extending over the hand holding portion 13 with the support end 17 located just past the second end 7 of the handle. When mounted in this manner, the overall length of the brush is not unduly lengthened using the stand. The shorter the brush, including the stand, the more stable it is when mounted upright.

In accordance with the present invention, the stand 15 is made from a resilient, flexible, moldable, material. This allows the legs 23 of the stand 15, when the hand holding portion 13 of the handle 3 of the brush, and the stand 15 thereon, is gripped by the user, to be easily collapsed together from its normal at-rest position, so as not to unduly interfere with the user's grip and manipulation of the brush 1 during use. The material used for the legs 23 allows them, during use of the brush, to be collapsed into a cross-sectional area not much greater than the cross-sectional area of the handle. When brushing is completed, the user sets the brush 1 on its stand 15, the legs 23 of the stand releasing and returning to their original at-rest position shown in FIG. 2. The material selected, while resilient and flexible, must have enough stiffness to have the legs support the brush in the upright storage position.

The stand 15, in a preferred embodiment, is integral with the handle 3 and is molded onto the handle during the making of the brush in a known, two-step, injection molding process. In the process, the handle is injection molded first from a first material and then the stand is injection molded onto the handle from a second material. The handle is made from a relatively rigid thermoplastic material such as, for example, a polypropylene, a polyamide (such as nylon), or a polyester. The handle 3 could have Shore A hardness ranging from about 70 to 100. The stand 15 can be made from an elastomeric thermoplastic or the like such as, for example, styrene-ethylene/butylene-styrene copolymers; thermoplastic polyurethane; or mixtures of polypropylene and natural rubber. The stand could have a Shore A hardness ranging from about 10 to 40.

While the brush 1 has been described with a handle 3 having an integrally molded stand 15 thereon, the stand could be molded separately from the handle and then affixed onto the hand holding portion 13 of the handle in a manner to prevent its removal during normal use of the brush. The stand could be held in place on the handle frictionally, or adhesively, by way of example. In another embodiment, the handle could provided with the collar integral thereon, the collar formed from the same first material as the handle. The legs, comprising the stand, could be molded separately from the second material. Suitable cooperating connecting means on the periphery of the collar and on the upper end of the legs would allow the legs to be connected to the collar. The connection could be permanent. By way of example, the connecting means could comprise a bayonet/slot type connection with slots formed around the periphery of the collar and the upper ends of the legs each having a 'bayonet' type end connection cooperating with a slot.

Figure 3:
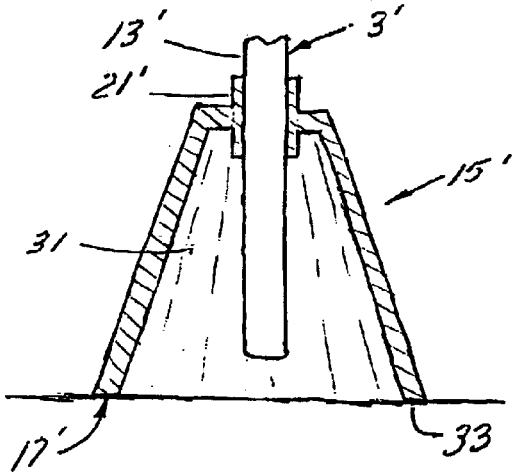
FIG. 3 is a partial front view, in section, showing another embodiment of the toothbrush.
Figure 4:
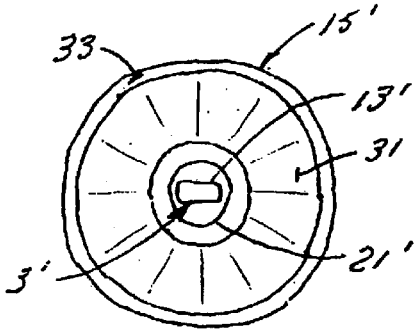
FIG. 4 is a bottom view of the embodiment shown in FIG. 3.

While one shape of stand 15 has been described, other shapes can be employed. The stand 15' could, for example, as shown in FIGS. 3 and 4, comprise a central collar 21', having a truncated, conical skirt 31 extending outwardly and downwardly from the collar 21'. The skirt 31 terminates in a circular edge 33 which forms the support end 17' of the stand 15'. The skirt 31 folds and collapses on itself when the hand holding portion 13' of the handle 3 of the brush, and the stand 15' thereon, are grasped by the user. The skirt 31 returns to its original shape when released by the user.

The stand 15 can have other shapes as well other than a tripod shape or a conical, skirt shape. The stand could, for example, be bell-shaped, or cup-shaped. The stand could also be a solid member provided that it is made of material that is resilient and easily squeezed and that it has a flat support end 17. For example the stand 15 could be a solid, truncated, conical block molded onto the hand portion of the handle.

Figure 5:
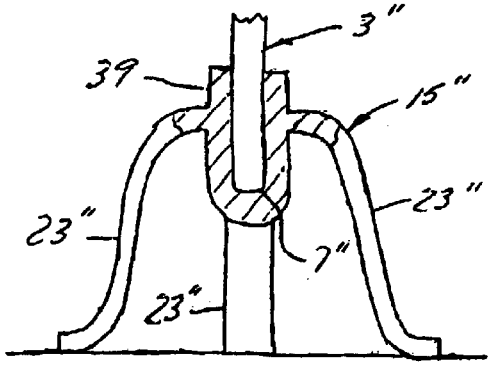
FIG. 5 is a partial cross-section view of yet another embodiment of the toothbrush.

The stand 15 has been described in most embodiments as being mounted onto the handle 3 with a collar 21. The stand 15" could also have a cup-shaped member 39 from which the legs 23" extend, as shown in FIG. 5, the cup-shaped member 39 receiving the end 7" of the handle 3" of the toothbrush. Again, the stand 15" could be molded integrally with the handle or it could be attached to the handle by suitable means.

I claim:

1. A stand-up toothbrush having: an elongated handle having a first end and a second end; a head at the first end of the handle with bristles on the head; a hand holding portion on the handle adjacent the second end of the handle, the hand holding portion at least long enough to be fully grasped by the hand of the user; a stand on the hand holding portion of the handle at the second end, the stand extending past the second end of the handle and terminating in a support end, the support end extending transverse to the handle; the support end, in its at-rest position, normally encompassed by an imaginary circle having a diameter at least four times the width of the hand holding portion of the handle; the handle made from relatively rigid material; at least a part of the stand, including the support end, made from resilient, flexible material of the type allowing the stand to be (squeezed) deformed against the hand (handle) holding portion of the handle when the user grasps the stand and the hand (handle) holding portion to use the toothbrush, and allowing the stand to return to its at-rest position when the user releases his grasp after using the toothbrush; the stand, when in its at-rest position and placed with its support end on a horizontal surface, supporting the toothbrush in an upright storage position.

2. A toothbrush as claimed in claim 1 wherein the handle ranges in overall length from four to seven inches and in width, at the hand holding portion, from three-eighths to five-eighths inches.

3. A toothbrush as claimed in claim 2 wherein the stand is integral with the handle.

4. A toothbrush as claimed in claim 3 wherein the stand has a collar surrounding the handle and at least three legs extending outwardly and downwardly from the collar when the brush is generally upright, the bottom of the legs forming the support end of the stand, at least the legs of the stand made from resilient material.

5. A toothbrush as claimed in claim 3 wherein the stand has a collar surrounding the handle and a tapered skirt extending outwardly and downwardly from the collar when the brush is generally upright, the bottom circular edge of the skirt forming the support end of the stand, at least the skirt of the stand made from resilient material.

6. A toothbrush as claimed in claim 2 wherein the stand is made separately from the handle and is attached to the handle in a manner to have it remain on the handle during normal use of the brush.

7. A toothbrush as claimed in claim 6 wherein the stand has a collar surrounding the handle and at least three legs extending outwardly and downwardly from the collar when the brush is generally upright, the bottom of the legs forming the support end of the stand, at least the legs of the stand made from resilient material.

8. A toothbrush as claimed in claim 6 wherein the stand has a collar surrounding the handle and a tapered skirt extending outwardly and downwardly from the collar when the brush is generally upright, the bottom circular edge of the skirt forming the support end of the stand, at least the skirt of the stand made from resilient material.

9. A toothbrush as claimed in claim 1 wherein the stand is integral with the handle.

10. A toothbrush as claimed in claim 9 wherein the stand has a collar surrounding the handle and at least three legs extending outwardly and downwardly from the collar when the brush is generally upright, the bottom of the legs forming the support end of the stand, at least the legs of the stand made from resilient material.

11. A toothbrush as claimed in claim 9 wherein the stand has a collar surrounding the handle and a tapered skirt extending outwardly and downwardly from the collar when the brush is generally upright, the bottom circular edge of the skirt forming the support end of the stand, at least the skirt of the stand made from resilient material.

12. A toothbrush as claimed in claim 1 wherein the stand is made separately from the handle and is attached to the handle in a manner to have it remain on the handle during normal use of the brush.

13. A toothbrush as claimed in claim 12 wherein the stand has a collar surrounding the handle and at least three legs extending outwardly and downwardly from the collar when the brush is generally upright, the bottom of the legs forming the support end of the stand, at least the legs of the stand made from resilient material.

14. A toothbrush as claimed in claim 12 wherein the stand has a collar surrounding the handle and a tapered skirt extending outwardly and downwardly from the collar when the brush is generally upright, the bottom circular edge of the skirt forming the support end of the stand, at least the skirt of the stand made from resilient material.

15. A toothbrush as claimed in claim 1 wherein the hand holding portion of the handle has a collar integrally molded thereon, and the stand comprises a set of legs, the legs and collar having cooperating connecting means to connect the legs to the collar to extend outwardly and downwardly when the brush is generally upright; at least the legs being made from resilient material.

* * * * *